United States Patent [19]

Goff

[11] Patent Number: 4,792,258

[45] Date of Patent: Dec. 20, 1988

[54] COLLAPSIBLE WARNING BARRICADE APPARATUS

[75] Inventor: LeRoy L. Goff, Addison, Ill.

[73] Assignee: Warning Lites of Illinois, Inc., Addison, Ill.

[21] Appl. No.: 80,654

[22] Filed: Aug. 3, 1987

[51] Int. Cl.[4] ..... E01F 9/01; E01F 13/00

[52] U.S. Cl. ..... 404/6; 404/10; 116/63 R; 116/63 P; 40/607; 40/610; 40/611; 40/612; 49/49; 49/131

[58] Field of Search ..... 404/6, 9, 10; 116/63 R, 116/63 P, 63 C, 63 T; 40/606, 607, 608, 610, 611, 612; 49/9, 33, 49, 131; 256/1, 13.1

[56] References Cited

U.S. PATENT DOCUMENTS

| | | | |
|---|---|---|---|
| 1,460,200 | 6/1923 | Laverence | 49/49 |
| 3,077,852 | 2/1963 | Gunderson | 116/63 P |
| 3,123,041 | 3/1964 | Gunderson | 116/63 P |
| 3,253,570 | 5/1966 | Gunderson | 116/63 P |
| 3,737,010 | 6/1973 | Nelson et al. | 188/32 |
| 4,183,695 | 1/1980 | Wilcox | 404/6 |
| 4,190,379 | 2/1980 | Toro Sosa et al. | 404/6 |
| 4,298,186 | 11/1981 | Glass | 404/6 X |
| 4,475,101 | 10/1984 | Kulp et al. | 404/6 X |

FOREIGN PATENT DOCUMENTS

| | | | |
|---|---|---|---|
| 2484679 | 12/1981 | France | 404/10 |
| 2077798 | 12/1981 | United Kingdom | 49/131 |

*Primary Examiner*—Stephen J. Novosad
*Assistant Examiner*—John F. Letchford
*Attorney, Agent, or Firm*—Dick and Harris

[57] ABSTRACT

A collapsible warning barricade apparatus for restricting access to a designated area by vehicular and pedestrian traffic in which at least an upstanding portion of the apparatus is capable of collapsing towards a substantially ground surface-hugging position upon impact from traffic, as well as capable of collapsing into a substantially flat position for transportaion and/or storage. The barricade is restrained in its substantially upright position by two support runners which are pivotally attached to the barricade member. At each pivot point, automatic locking and biasing apparatus allow the barricade member to rotate from a locked upright position upon impact to a locked ground surface-hugging position. The support runners of the barricade may additionally be provided with spurs along the top edge to affix a sandbag, when required for ballast. A variety of signalling indicia are further integrated into the barricade member for warning emphasis.

14 Claims, 2 Drawing Sheets

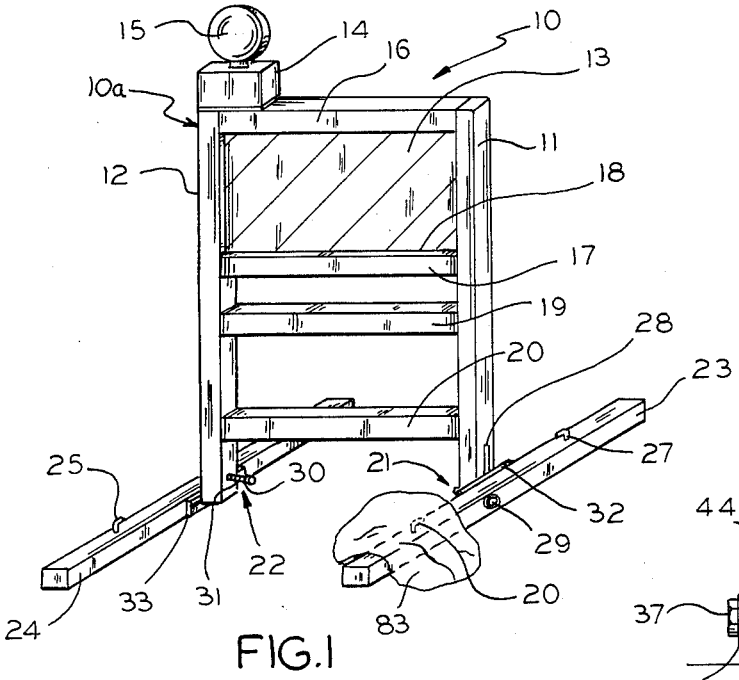
FIG.1
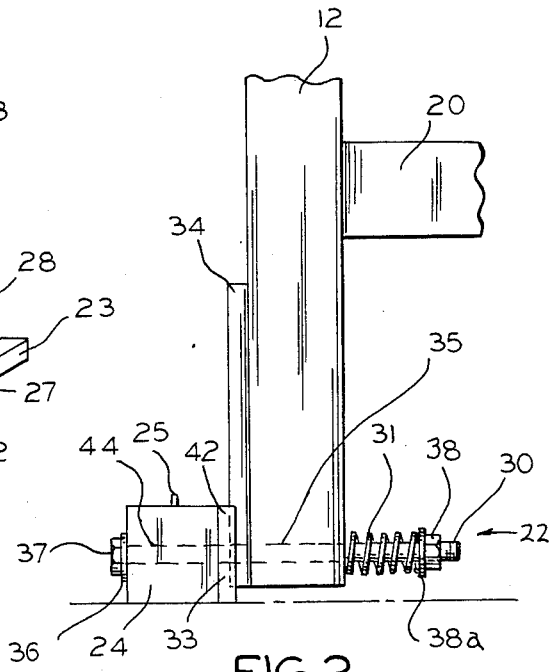
FIG.2
FIG.3
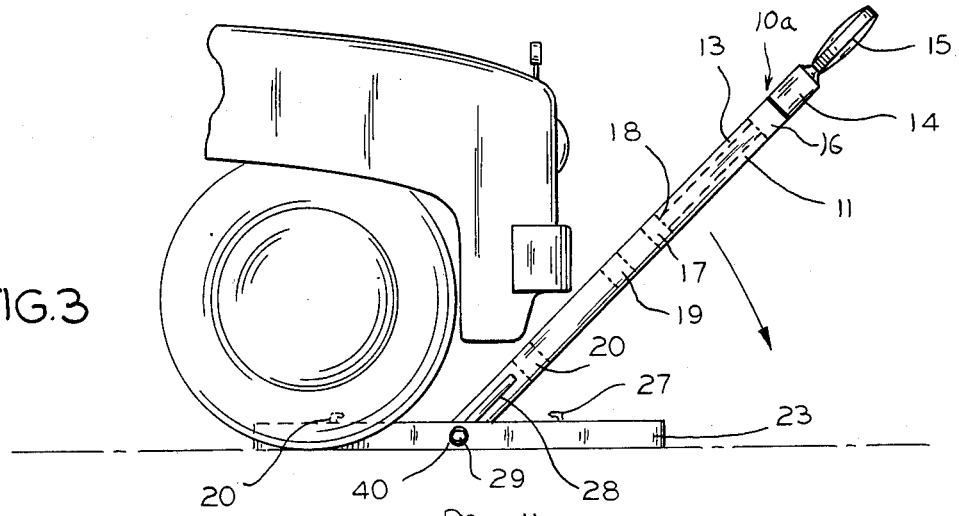
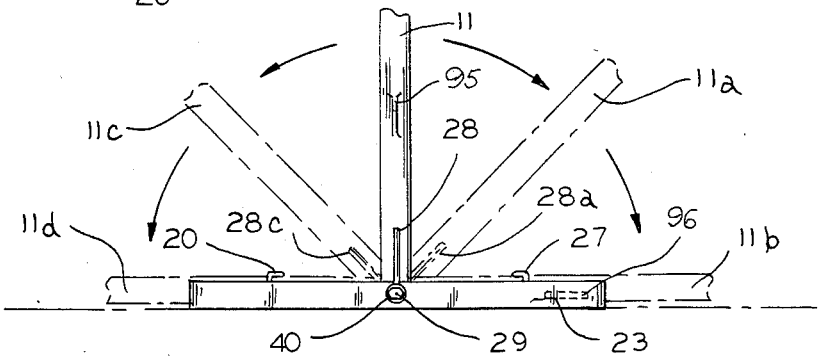
FIG.4

COLLAPSIBLE WARNING BARRICADE APPARATUS

BACKGROUND OF THE INVENTION

The present invention relates generally to area warning apparata and in particular to a collapsible warning barricade apparatus for restricting access to a designated area by vehicular and pedestrian traffic, in which at least an upstanding portion is capable of collapsing to a substantially ground surface-hugging position upon impact from traffic as well as capable of collapsing into a substantially flat position for transportation and/or storage.

Most of the barricades currently in use today are of the "A" frame design consisting of two sides which bolt together at the top. The barricade opens up to form the "A" frame configuration. Each side of the "A" frame barricade has a reflective panel affixed to it and usually another support below which is used to support a sandbag for ballast. Most of these barricade structures are made of either wooden or plastic panels supported by four steel legs. The panels are either bolted or riveted to the steel legs.

There are also some barricades in use today which have a single vertical member with a tubular bottom support. While some of these collapse through pivoting, such as shown in U.S. Pat. No. 4,183,695, none automatically lock, upon collapse, to prevent riding up into the undercarriage of a vehicle.

Since the barricades currently in use are often too light to withstand the wind created by vehicles passing by at high speeds, they are ballasted. Ballasting is usually done by means of addition of an extra weight, such as a sandbag being draped over the bottom support of the barricade. This adds the needed weight and allows the barricade to be held in place.

A problem which has often occurred in barricades currently in use today is that when they are struck by a passing vehicle, rather than collapsing into a substantially flattened position, they are often thrown violently into the air, striking anything in its path, and often causing damage to the barricade, as well as possible damage to the automobile and injuries to the automobile passengers or pedestrians. Furthermore, the damaged barricades usually need to be completely replaced as there are few truly interchangeable parts. In short, the barricades currently in use can be costly relative to damage to property and damage to the barricade itself.

Accordingly, an object of the proposed invention is to provide a barricade which can collapse upon impact, and lock in a substantially ground surface-hugging position so that the vehicle can pass safely over it. Since the barricade locks in this position, it will not bounce up and be hooked on the underside of the automobile and thus dragged down the highway.

A further object of this invention is to provide a barricade having barricade supports that will remain in relatively the same position occupied prior to impact, after impact from the moving motor vehicle. This feature is achieved by integrating into the support runners themselves, sandbag spurs to which a sandbag may be affixed and used for ballast, towards keeping the support runners in place during and after impact. As the top portion of the barricade is absorbing most of the energy and the bottom is held in place by the sandbags, the barricade does not have as great a chance to be thrown into a "live" lane of traffic.

Yet another object of the invention is to provide a barricade in which the ballast or sandbag is not supported by any portion of the barricade which receives the impact from the moving vehicle. Since the sandbags are draped on the support runners which are in substantially ground surface-hugging positions, they do not add to the weight of the upright member, and the impacting vehicle is met with less resistance than when striking the types of barricades currently in use today. Such a construction further presents a lower center of gravity to the overall barricade construction.

Another object of the invention is to provide a barricade in which the reflective panels are recessed into their holders. This feature protects the panels from scratching during impact, transportation and storage, to result in cost savings for the barricade user, as well as better nighttime visibility of reused barricades, to vehicle operators.

Still another object of the invention is to provide a structure in which the barricade member, in its collapsed position, is hugging the surface of the road so as to be able to withstand the weight of the vehicle driving over it without significant damage, while simultaneously locked into place with the ground hugging barricade support.

Yet a further object of the invention is to provide a barricade structure that accommodates individual interchangeable components, unlike most other barricades, so that when breakage does occur, only the specific broken component needs to be replaced instead of replacing the entire barricade. This results in less cost to the barricade user.

Other objects of the invention include provision of a barricade that will collapse in either direction, which is also changeable, modularly, for conversion from one panel to a two panel configuration and back to one panel. This avoids the problem which occurs in current plastic barricades which have the reflective sheeting applied directly to a nonremovable panel. If two reflective panels are required, the reflective sheeting could otherwise be sacrificed when a one panel configuration was again required. Greater versatility of the proposed invention again benefits the barricade user in cost savings. Additionally, use of a sandbag at the bottom of the barricade precludes distortion of the barricade which may be caused by the weight of the sandbag, as opposed to barricades currently in use which often distort under the weight of the sandbag and which eventually bend out of regulation height. Again, this feature provides for safety and greater cost savings to the barricade user.

These and other objects of the invention will become apparent upon reference to the following specification drawings and claims.

SUMMARY OF THE INVENTION

The present invention comprises a collapsible warning barricade apparatus for restricting access to a designated area by automotive vehicles and/or predestrian traffic. In the barricade apparatus, an upstanding portion of the apparatus is capable of collapsing toward a substantially ground surface-hugging position upon impact from this traffic, as well as is capable of collapsing into a substantially flat position for transportation and/or storage.

The barricade apparatus itself comprises a barricade member capable of being positioned in a substantially upright position, either vertically or at various orientations depending upon the slope of the surface upon which it is placed. The barricade member includes signalling means for warning the vehicular and pedestrian traffic of the location of the restricted area it is serving to restrict access thereto. Barricade support means are operably and pivotally attached to the barricade member by pivot means for alternatively supporting the barricade member in a substantially restrained (for example, upright) position atop the ground surface so as to permit the barricade member to pivotally rotate downwardly to its alternate ground surface-hugging position.

The barricade support means further includes bias means operably interposed between it and the barricade member for further maintaining the barricade member in its substantially upright position in a restrained manner. The pivot means enable the barricade member to pivot upon impact from the traffic, upon overcoming the force of the bias means, towards repositioning the barricade member to any position along its original upright position down to its substantially ground surface-hugging position—without substantial relocation of the barricade support means. Automatic locking means are operably positioned between the barricade member and the barricade support means for automatically locking the barricade member into its collapsed position relative to the barricade support means, to preclude against the inadvertent migration, rebounding and/or repositioning of the barricade member from its substantially ground surface-hugging position. Through such a structure and arrangement, the user of such a collapsible barricade further avoids impact damage to the barricade member as well as avoids damage to the undercarriages of vehicles, while precluding further injury to pedestrians, and simultaneously providing a locked substantially flat profile co-planar to the overall collapsed apparatus for reduced damage thereto as well as for transportation and/or storage thereof.

In one embodiment of the apparatus, the barricade member comprises a substantially rectangular barricade element employing two substantially parallel leg support members operably and pivotally attached to the barricade support means at the pivot means. This embodiment additionally employs two cross support members operably positioned between the leg support members to provide receipt and retention of at least one substantially rectangular shaped signalling means, such as a striped hazard display, for purposes of warning. The cross support members in this particular embodiment are substantially parallel to each other and are operably interposed between the two leg support members in a position substantially perpendicular to the leg support members. In an alternative embodiment, the barricade member comprises this substantially rectangular barricade element, with two substantially parallel leg supports operably and pivotally attached to the barricade support means, at the pivot means, while employing at least four cross support members operably positioned between the leg support members to provide receipt and retention of at least two rectangular shaped signalling means. In this embodiment the four or more cross support members are substantially parallel to each other and operably interposed between the two leg support members in an equilavent fashion to the other embodiment, that is, substantially perpendicular to the leg support members.

In the preferred embodiment of the invention the signalling means comprises, as mentioned, the substantially rectangular graphic warning indicia member which is operably integrated to the barricade member for movement therewith. In yet other embodiments the signalling means comprises a light emitting signalling member such as a caution lamp or flashing light, which is again equivalently integrated to the barricade member for movement therewith.

In the preferred embodiment of the invention the barricade support means comprises at least two substantially parallel support runners, each operably attached for said pivotal rotation relative to respective ones of the two leg support members embodied by the barricade member itself. Each of these support runners are attached to each of the leg support members, respectively, at the lowermost ends of the leg support members, substantially midway along the longitudinal length of the support runners. The barricade support means are accordingly attached to the barricade member through operable communication between the barricade leg supports and the barricade support runners in which the pivot means are operably interposed therebetween.

The invention further contemplates the barricade support means as further embodying one or more sandbag retention spurs operably positioned along at least one of the two barricade support runners, for the secure affixation and maintenance of one or more sandbags thereat, in which the sandbags serve as ballast for the warning barricade apparatus to further preclude against the undesired migration of the barricade support means and in turn, the overall collapsible warning barricade apparatus, upon impact with said traffic as well as that which may occur from wind and/or other weather conditions. These one or more sandbag spurs are located at approximately $\frac{1}{4}$ the longitudinal length of the support runner, as measured from the end of same.

The pivot means are operably connected between the barricade support means and the barricade member and, preferably comprise a pin member penetrating a portion of each of the barricade support means and the barricade member proximate to the region of pivotal attachment therebetween. This pin member permits controlled pivotal rotation of the barricade member relative to the fixed ground surface-hugging position of the barricade support means.

The bias means comprises a compression spring element, in the preferred embodiment, which is operably interposed proximate to the pivot means, to exert a spring bias force at the region of operable connection between the barricade member and the barricade support means. This compression spring element cooperates with the pivot means to create this bias force between the barricade member and the barricade support means, which bias force must be overcome in order to pivot the barricade member from any preselected upstanding position to its collapsible position in said ground surface-hugging position.

In this preferred embodiment of the invention, the automatic locking means comprises a plurality of mated nesting members having female and male interlocking elements. The male interlocking elements are positioned on either one of the barricade member or barricade support means, with the female elements being positioned in alignment with the male elements on the other of the barricade member or barricade support means at a region immediately proximate to the pivot means. These male and female interlocking elements serve to nest with one another upon alignment achieved through angular displacement of the barricade member about the pivot means. The nesting of the male and female interlocking members enables the locking of the position of the barricade member relative to the barricade support means, under the spring bias force of the biasing means, which locking of same may be overcome upon further application of a rotation prompting force upon the barricade member, such as a force exerted through impact with said traffic or through the intentional prompting of same when said collapsible barricade is collapsed to its storage or transportation profile. This additional rotation prompting force serves to relocate particularly aligned ones of the male and female interlocking members toward a further aligned locking configuration, until said barricade member is prompted to the ground surface-hugging position, at which position said male and female interlocking members are again aligned so as to restrainably lock the position of the barricade member at said ground surface-hugging position, relative to the barricade support means, also located at the ground surface-hugging position.

Preferably, the interlocking male members comprise an integrated pattern of protruding male elements positioned in the lower end of the barricade member at the region immediately proximate to the pivot means. In this embodiment the interlocking female members comprise an equivalent integrated pattern of recessed female elements positioned in the barricade support means at a position substantially midway along the longitudinal axis of the barricade support means for operable alignment with the corresponding pattern of protruding male elements positioned in the lower end of the barricade member. These respective protruding male and recessed female elements are respectively arranged in radiating star patterns immediately approximate to the pivot means, at which location the barricade member and barricade support means are juxtaposed relative to one another so as to describe an angular displacement region at the pivot means, where the barricade member and the barricade support means alternatively lock into the locking configurations and release to a pivoting configuration relative to each other—as said barricade member rotates from its upright position to its ground surface-hugging position.

In another embodiment of the invention, the automatic locking means comprises remote locking elements located along the barricade support means at a position substantially remote to the pivot means. The remote locking elements include a locking element positioned along the barricade support means as well as a mated remote locking element positioned along the barricade member which is capable of alignment and fastening with the remote locking element on the barricade support means when the barricade member is pivoted downwardly to its ground surface-hugging position. The remote locking elements may be incorporated instead of or in conjunction with the previously described automatic locking means located proximate to the pivot means.

In one embodiment of the invention, the cross support members cooperating with the two leg support members forming the barricade member, restrainably receive and retain the substantially rectangular shaped signalling means through telescopic, indented, receipt thereof. Such a configuration maintains the signalling means isolated from damage when the barricade member is impacted by traffic as well as isolates the relatively expensive signalling means from abrasion and/or damage from the ground, upon the collapse of the barricade member into its ground surface-hugging position.

Upon full collapse of the barricade member, it and the barricade support means are substantially co-planar to reduce the opportunity for damage arising from vehicle rollover while inparting to the apparatus the narrowest possible collapsed profile for purposes of efficient transportation and/or storage.

BRIEF DESCRIPTION OF THE DRAWINGS

FIG. 1 of the drawings is a front perspective view of the invention particularly showing the collapsible warning barricade apparatus with its barricade member in a substantially upright position;

FIG. 2 is an enlarged front elevational view of the barricade member and barricade support means displaying the pivot, biasing and automatic locking features associated therewith;

FIG. 3 is a side elevational view showing the collapsible warning barricade apparatus in a partially collapsed position after impact by a vehicle;

FIG. 4 is a side elevational view of the pivotal barricade member showing the full rotational capability of this member relative to the barricade support;

DETAILED DESCRIPTION OF THE DRAWINGS

Figure 5:
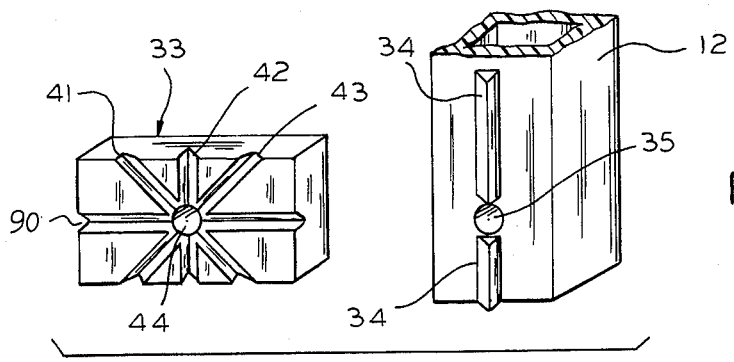
FIG. 5 is a perspective view of the female and male interlocking elements of the automatic locking means utilized in the present collapsible warning barricade apparatus.

While this invention is susceptible of embodiment in many different forms, there is shown in the drawings and will herein be described in detail, several specific embodiments with the understanding that the present disclosure is to be considered as an exemplification of the principals of the invention and is not intended to limit the invention to the embodiments illustrated.

The present inventive collapsible warning barricade apparatus 10 is shown in a substantially upright position in FIG. 1. The barricade member 10*a* includes cross-support members 16 and 17 positioned between two substantially parallel leg support members 11 and 12. Recessed flange 18 in cross member 17 enables recessed isolated receipt of signalling panel 13. Additional cross support members 19 and 20 may also be included for added stability. Rectangular graphic signalling indicia panel 13 is positioned within cross-support members 16 and 17, and leg support members 11 and 12 by recessing, so as not to be damaged during impact with a vehicle or with the ground. A light-emitting signalling device comprising a battery housing 14 and a light-emitting reflective lens 15 is also attached to cross-support member 16 and/or member 17 or leg 12, and, along with the indicia signalling panel 13, warns vehicular and pedestrian traffic of the restricted area.

Barricade member 10*a* also includes barricade support means at its base, the support means comprising substantially parallel support runners 23 and 24 connected proximate to the outside lower end of the respective leg support members 11 and 12. These runners support barricade member 10*a* in a variety of positions including a substantially upright position, as shown in FIG. 1.

Barricade member 10*a* further comprises pivot means 21 and 22 located at the proximate midpoints of support runners 23 and 24, including pivot pin members 29 and 30, which penetrate the support runners 23 and 24 as well as their respective juxtaposed leg support members 11 and 12—for pivoting the barricade member from a substantially upright position to a substantially ground surface-hugging position.

Barricade apparatus 10 also includes bias and automatic locking apparata which are located at the proximate midpoints of support runners 23 and 24 positioned between support runners 23 and 24, and their respective leg support members 11 and 12, for biasing and locking the barricade member 10*a* into various positions. The automatic locking apparatus comprises male 28 and female 32 interlocking elements which are located between support runner 23 and leg support member 11. A second equivalent automatic locking apparatus is positioned between support runner 24 and leg support member 12, proximate to pivot means 22.

The support runners are provided with sandbag spurs 20, 25 and 27 for affixing sandbags to serve as ballast against undesired migration of the collapsible warning barricade apparatus during impact from traffic or from wind and other weather conditions. Sandbag 83 is shown affixed to sandbag spur 20. The sandbag spurs are located at approximately one-fourth the longitudinal length of the support runners as measured from the ends of the support runners.

An enlarged view of the barricade support apparatus is shown in FIG. 2. Cross-support member 20 and left leg support member 12 are shown in a substantially upright position. The automatic locking apparatus including male 34 and female 33 interlocking elements are shown with male element 34 nested in the perpendicular groove 42 of female element 33. Pivot apparatus 22 is also shown as consisting of pivot pin member 30 which penetrates aperture 35 of leg support 12, male interlocking element 34, female interlocking element 33 and barricade support runner 24 with pivot aperture 44. Biasing means are shown consisting sisting of bias compression spring 31 which is held in place by washer 38*a* and nut 38. Pivot pin 30 is held in place on the outside of support runner 24 by washer 36 and nut 37. FIG. 2 also shows sandbag spur 25 located directly on top of support runner 24.

This nested configuration may be unlocked when the barricade member 10*a* is forced to rotate on its pivot apparatus sufficiently to overcome the biasing apparatus until the barricade member 10*a* eventually is displaced enough to lock into a different, locked, nesting configuration.

FIG. 3 shows barricade member 10*a* of the collapsible warning barricade apparatus 10 in a partially collapsed position during impact from a vehicle. When struck by a vehicle, the barricade collapses downwardly into a substantially ground surface-hugging position where it will lock relative to support runner 23 so as to be precluded from rebounding into the undercarriage of the vehicle. This drawing further shows the recessed feature of the rectangular graphic warning indicia panel 13, located between leg support members 11 and 12 and cross-support members 16 and 17, along recess 18 of cross member 17, so that upon collapse of barricade member 10*a* into its ground surface-hugging position, the relatively costly indicia panel will not be damaged from the impact from traffic or from abrasion with the ground. Light emitting signal device 15 is shown at the top of the barricade member 10 including its battery housing 14, though the invention contemplates positioning of device 15 anywhere along barricade member 10*a* where appropriately visible. Leg support 11 is also shown with cross support members 16, 17, 19 and 20 operably connected. Support runner 23 is also shown with sandbag spurs 20 and 27 located on its top. Male interlocking member 28 is shown as the barricade member is rotating downwardly to its ground surface-hugging position together with pivot pin 29 and washer 40.

FIG. 4. shows the complete collapsible capability of barricade member 10*a* in a multi-position view of leg support 11 in a substantially upright position. Leg support 11 can rotate completely downwardly to substantially ground surface-hugging position 11*d*. The barricade member may be locked in an angular position 11*c* when the male interlocking element 28 is nested into the angular positioned corresponding groove in the female interlocking element of the automatic locking apparatus. Leg support 11 can also rotate completely downwardly to substantially ground surface-hugging position 11*b* or to angular position 11*a* when the male interlocking element is nested into the angular positioned corresponding groove in the female interlocking element of the automatic locking apparatus. A secondary male interlocking element 95 in the barricade member may be utilized to further secure the barricade member in its ground surface-hugging position upon its nesting in aligned fastening element 96 in the barricade support means. Sandbag spurs 20 and 27 are shown located on top of support runner 23 and pivot pin 29 is shown together with washer 40.

A perspective view of the automatic locking apparatus, including female interlocking element 33 with grooves 41, 42, 43 and 90, for nesting with male interlocking element 34 is shown in FIG. 5. Interlocking element 34 is affixed to leg support 12 so as to be capable of nesting with either of female interlocking element recesses 41, 42, 43 and 90 on runner 24. Aperture 44 is located in female interlocking element 33 for penetration by pivot pin 30. Aperture 35 is equivalently located in leg support 12 also for penetration by pivot pin 30. As leg support 12 travels through its rotation, male interlocking element 34 may nest in any of the various grooves 41, 42, 43 and 90, upon alignment with element 33. When barricade member 10*a* is in its substantially upright position, male interlocking (protruding) member 34 is nested in female groove or recess 42. When the barricade member is partially collapsed into an angular position, male interlocking member 34 is nested in groove 41. When barricade member 10*a* is collapsed into its substantially ground surface-hugging position, male member 34 becomes nested in groove-recess 90, thereby locking the barricade member relative to the barricade support means. Equivalently, when barricade member 10*a* is partially collapsed into its opposite angular position, male member 34 is nested into groove-recess 43. When barricade member 10*a* is collapsed completely into its opposite ground surface-hugging position, male member 34 will lock again through nesting in groove 90.

Figure 6A:
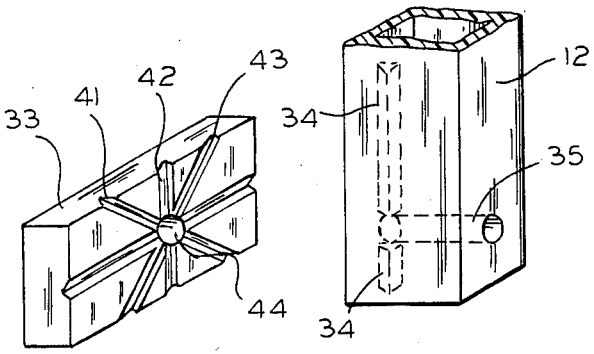
FIG. 6A is a perspective view of aligned male and female interlocking elements of the automatic locking means utilized in the present collapsible warning barricade apparatus.

The automatic locking apparatus is also shown in FIG. 6A where male interlocking member 34 is aligned to correspond with groove 42, as leg support member 12 is in its substantially upright position. Groove-recesses 41, 43 and 90 are also shown as well as are pivot pin apertures recesses 44 and 35.

Figure 6B:
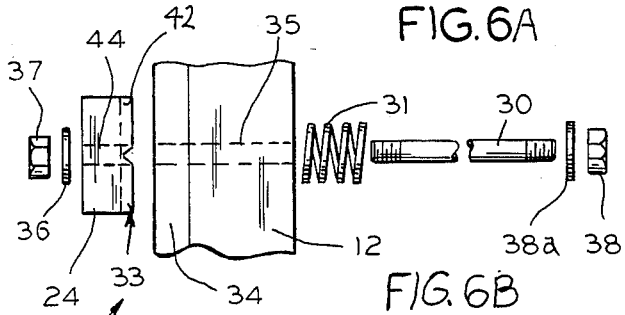
FIG. 6B is an exploded, front elevational view of the barricade member and barricade support means, particularly displaying the pivot, biasing, and automatic locking features associated therewith.

Shown in FIG. 6B is an exploded view of the integrated automatic locking, bias and pivot means 22. Leg support 12 is shown in a substantially upright position with male interlocking member 34 in an aligned position to operably nest within groove-recess 42. Female interlocking member 33 is also shown operably connected to support runner 24 having aperture 44 for pivot pin 30. Support runner 24 including female locking element 33, aperture 35 in male interlocking element 34, coupled to leg support 12, are also shown for penetration by pivot pin 30 passing through bias compression spring 31, which, in turn, is held in place by washer 38*a* and nut 38. Pivot pin 30 is held in place at its opposite side by washer 36 and nut 37.

Figure 7:
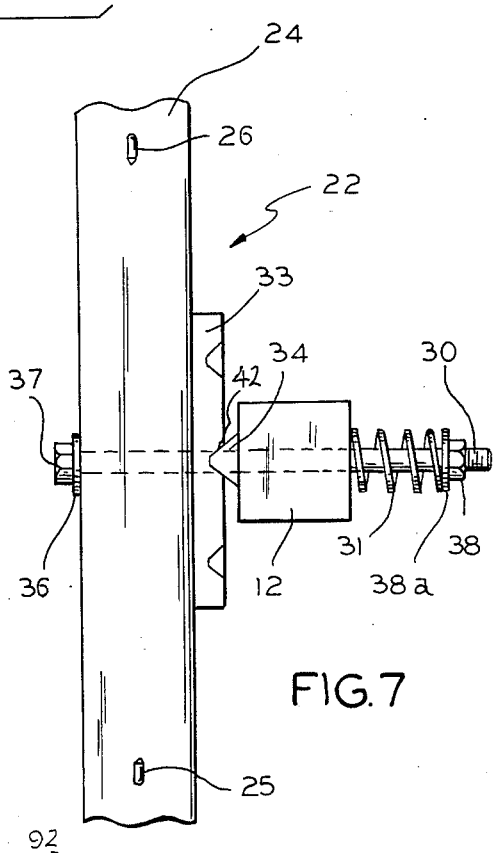
FIG. 7 is a top plan view of the barricade member and barricade support means, particularly displaying the pivot, biasing and automatic locking features associated therewith.

A top plan view of the automatic locking, bias and pivot means 22, in an assembled configuration, are shown in FIG 7. Leg support 12 is shown with male interlocking element 34 operably connected therewith, nesting in groove-recess 42 of corresponding female interlocking element 33 operably integrated to support runner 24. Pivot pin 30 is shown passing through leg support 12, male interlocking element 34, female interlocking element 33 and support runner 24. Bias compression spring 31 is held in place by washer 38*a* and nut 38 which bias male interlocking element 34 into groove 42 of female interlocking element 33. Pivot pin 30 is further shown fastened at its other end by washer 36 and nut 37, and sandbag spurs 25 and 26 are shown located at the top of support runner 24.

Figure 8:
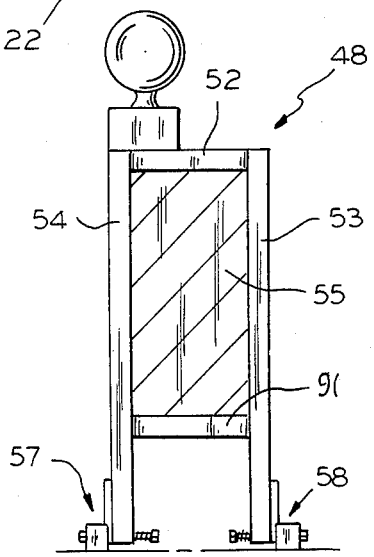
FIG. 8 is a front elevational view of an embodiment of barricade apparatus showing the collapsible warning barricade apparatus as embodying a single signalling panel.

FIG. 8 shows an alternative embodiment of collapsible warning barricade apparatus 48. This embodiment utilizes shorter cross bar support members 52 and 91 shown operably connected between parallel leg supports 53 and 54. A single warning indicia signalling panel 15 is shown together with barricade support runners 57 and 58.

Figure 9:
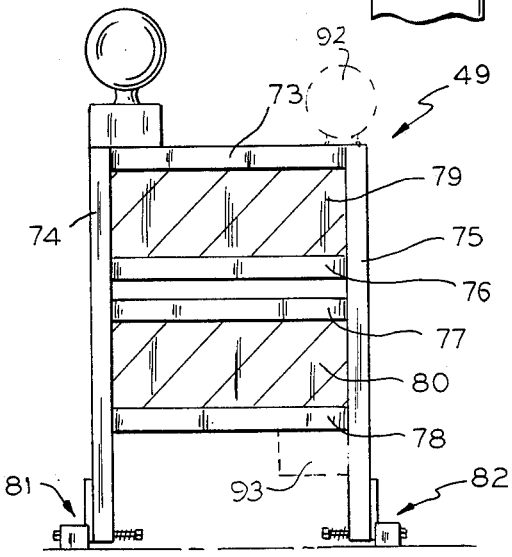
FIG. 9 is a front elevational view of an embodiment of barricade apparatus showing the collapsible warning barricade apparatus as embodying a double signalling panel.

FIG. 9 shows yet another alternative embodiment featuring two rectangular graphic warning indicia signalling panels 79 and 80. Additional cross support members 73 and 76 through 78 are utilized in this embodiment, with cross-support members 73 and 76 being located at the top and bottom of signalling indicia panel 79, and cross support members 77 and 78 being located at the top and bottom of signalling indicia panel 80. Barricade leg members 74 and 75 are shown together with barricade support runners 81 and 82. In an alternative embodiment, light signalling device 92 is directly attached to member 73 and connected by wire to battery housing 93, operably connected at the bottom of cross-support member 78 for example thus to impart to barricade apparatus 49, an overall lower center of gravity.

The foregoing description and drawings merely explain and illustrate the invention and the invention is not limited thereto, except insofar as the amended claims are so limited, as those skilled in the art who have the disclosure before them will be able to make modifications and variations therein without departing from the scope of the invention. By way of example, male and female interlocking members 33 and 34 are contemplated by the invention as embodying independent attachable elements or, alternatively may be integrated into their respective runner and leg assemblies as one integrated structure respectively.

What is claimed is:

1. A collapsible warning barricade apparatus for restricting and blocking access to a designated area by vehicular and pedestrian traffic, in which at least an upstanding portion of the apparatus is capable of fully collapsing toward and being maintained in a substantially ground surface-hugging position upon impact from said traffic, without damage to same, as well as is capable of collapsing into a substantially flat position for transportation and/or storage, said collapsible warning barricade apparatus comprising;

a barricade member capable of being positioned in a substantially upright position, signaling means operably attached to said barricade member for warning said vehicular and pedestrian traffic of the location of said restricted area;

barricade support means operably and pivotally attached to said barricade member by pivot means for alternatively supporting said barricade member in a substantially restrained upright position atop said ground surface, and permitting said barricade member to pivotally rotate downwardly to said ground surface-hugging position upon impact from a moving vehicle, said barricade support means including bias means operably interposed between it and said barricade member, for further maintaining said barricade member in said substantially restrained upright position, said pivot means enabling said barricade member to pivot upon impact from said moving vehicle, upon overcoming said bias means, towards repositioning said barricade member to its said substantially ground surface-hugging position without substantial relocation of said barricade support means, said barricade member further being of such a construction so as to remain substantially intact, so as to preclude damage to same, as a result of said impact;

automatic locking means operably positioned between said barricade member and said barricade support means for automatically locking said barricade member into its collapsed position, upon impact from said moving vehicle, relative to said barricade support means to preclude against inadvertent migration, rebounding and repositioning of said barricade member from its said substantially ground surface-hugging position, so as to further preclude damage to said barricade member, as well as to further allow the tires of said moving vehicle to roll over said repositioned barricade member without impact damage to said barricade member, thereby enabling redeployment and reuse of said apparatus while obviating the need for replacement of said barricade member, and further precluding impact damage to the undercarriage of said moving vehicle as well as precluding injury to pedestrians, while alternatively providing a locked substantially flat profile for transportation and/or storage of the barricade apparatus.

2. The invention according to claim 1 in which said barricade member comprises a substantially rectangular barricade element having two substantially parallel leg support members operably and pivotally attached to said barricade support means through said pivot means, said substantially rectangular barricade element further including at least four cross support members operably positioned between said leg support members to provide receipt and retention of at least two rectangular shaped signalling means, said at least four cross support members being sunstantially parallel to each other and operably interposed between said two legs support members in a position substantially perpendicular thereto.

3. The invention according to claim 1 in which said signalling means comprises a substantially rectangular graphic warning indicia member, said graphic warning indicia member being operably integrated to said barricade member for movement therewith.

4. The invention according to claim 1 in which said signalling means comprises a light emitting signalling member, said light emitting signalling member being operably integrated with said barricade member for movement therewith.

5. The invention according to claim 1 in which said pivot means operably connected between said barricade support means and said barricade member comprises a pin member penetrating a portion of each of said barricade support means and said barricade member, proximate to the region of pivotal attachment therebetween, said pin member permitting controlled pivotal rotation of said barricade member relative to the fixed ground surface-hugging position of said barricade support means.

6. The invention according to claim 1 in which said automatic locking means comprises remote locking elements located along said barricade support means at a position substantially remote to said pivot means;

said remote locking elements including a locking element therepositioned along said barricade support means as well as a mated remote locking element positioned along said barricade member capable of alignment and fastening with said remote locking element in said barricade support means when said barricade member is pivoted to its said ground surface-hugging position for restrainably locking said barricade member in said ground surface-hugging position relative to said barricade support means.

7. The invention according to claim 1 in which said barricade member collapses to a position which is substantially co-planar with the ground surface-hugging position of said barricade support means to preclude the opportunity of increased damage thereto, upon rollover by a vehicle as well as to minimize the collective profile thereof for purposes of transportation and storage.

8. The invention according to claim 1 in which said barricade member comprises a substantially rectangular barricade element having two substantially parallel leg support members operably and pivotally attached to said barricade support means through said pivot means, said substantially rectangular barricade element further including at least two cross support members operably positioned between said leg support members to provide receipt and retention of at least one substantially rectangular shaped signalling means, said cross support members being substantially parallel to each other and operably interposed between said two leg support members in a position substantially perpendicular thereto.

9. The invention according to claim 8 in which said barricade support means comprises at least two substantially parallel support runners each operably attached for pivotal rotation relative to respective ones of said two leg support members, each of said support runners being attached through at the lowermost ends of said leg support members, substantially midway along the longitudinal length of said support runners, said barricade support means being attached to said barricade member, through operable communication between said barricade leg supports and said barricade support runners in which said pivot means are operably interposed therebetween.

10. The invention according to claim 9 in which said barricade support means further includes one or more sandbag retention spurs operably positioned along at least one of said two barricade support runners for the secure affixation and maintenance of one or more sandbags thereat, in which said one or more sandbags serve as ballast for said warning barricade apparatus to further preclude against the undesired migration of said barricade support means and the overall collapsible warning barricade apparatus, upon impact with said traffic as well as from wind and other weather conditions, said one or more sandbag spurs being located at approximately one-fourth the longitudinal of said support runner, as measured from the end of same.

11. The invention according to claim 8 in which said at least two cross support members and two leg support memebers restrainably receive and retain said at least one substantially rectangular shaped signalling means through telescopic indented receipt thereof, so as to maintain said signalling means isolated from damage when said barricade member is either impacted by traffic, as well as isolated from abrasion or damage from the ground upon the collapse of said barricade member into its said ground surface-hugging position.

12. The invention according to claim 1 in which said bias means comprises a compression spring element operably interposed proximate to said pivot means to exert a spring bias force at the region of operable connection between said barricade member and said barricade support means, said compression spring element cooperating with said pivot means to create a bias force between said barricade member and said barricade support means, which bias force must be overcome in order to pivot said barricade member from any preselected upstanding position to its collaspible position in said ground surface-hugging position.

13. The invention according to claim 12 in which said automatic locking means comprises a plurality of mated nesting members having female and male interlocking elements, said male interlocking elements being positioned on one of said barricade member and barricade support means with said female elements being positioned in alignment with said male elements on the other of said barricade member and barricade support means, at a region immediately proximate to said pivot means, said male and female interlocking elements serving to nest with one another upon alignment achieved through angular displacement of said barricade member about said pivot means, said nesting of said male and female interlocking members enabling locking of the position of said barricade member relative to said barricade support means under said spring bias force of said biasing means, which locking of same may be overcome upon further application of a rotational prompting force upon said barricade member, said additional rotation prompting force serving to relocate particular aligned ones of said male and female interlocking members toward a further aligned locking configuration, until said barricade member is prompted to said ground surface-hugging position, at which position said male and female interlocking members are again aligned so as to restrainably lock the position of said barricade member at said ground surface-hugging position relative to said barricade support means also located at said ground surface-hugging position.

14. The invention according to claim 13 in which said interlocking male members comprise an integrated pattern of protruding male elements positioned in the lower end of said barricade member at said region immediately proximate to said pivot means, said interlocking female members comprising an integrated pattern of recessed female elements positioned in said barricade support means at a position substantially midway along the longitudinal axis of said barricade support means for operable alignment with said pattern of protruding male elements positioned in the lower end of said barricade member, said respective protruding male and recessed female immediately proximate to said pivot means at which said barricade member and said barricade support means are juxtaposed relative to one another, so as to describe an angular displacement region at said pivot means where said barricade member and said barricade support means alternatively lock into said locking configuration and release to a pivoting configuration relative to each other, as said barricade member rotates from its upright position to its ground surface-hugging position.

* * * * *

UNITED STATES PATENT AND TRADEMARK OFFICE

CERTIFICATE OF CORRECTION

PATENT NO. : 4,792,258

DATED : December 20, 1988

INVENTOR(S) : Goff

It is certified that error appears in the above-identified patent and that said Letters Patent is hereby corrected as shown below:

| | |
|---|---|
| Col. 7, line 57 | After "consisting" delete "sisting" |
| Col. 11, line 15 | After "being" delete "sun-" and insert instead --sub--- |
| Col. 14, line 15 | Before "immediately" insert --elements being respectively arranged in radiating star patterns-- |

Signed and Sealed this

Fourth Day of July, 1989

*Attest:*

*Attesting Officer*

DONALD J. QUIGG

*Commissioner of Patents and Trademarks*